United States Patent [19]

Deal, III et al.

[11] Patent Number: 4,770,711

[45] Date of Patent: Sep. 13, 1988

[54] METHOD FOR CLEANING CHEMICAL SLUDGE DEPOSITS OF OIL STORAGE TANKS

[75] Inventors: James F. Deal, III, Amelia Island; Anderson M. Foote, III, Fernandina, both of Fla.; Stephen R. Gabbard, Broken Arrow, Okla.

[73] Assignee: Petroleum Fermentations N.V., Curacao, Netherlands Antilles

[21] Appl. No.: 644,481

[22] Filed: Aug. 24, 1984

[51] Int. Cl.[4] ..... B08B 7/04

[52] U.S. Cl. ..... 134/18; 134/22.1; 134/22.11; 134/22.12; 134/; 134/25.4; 134/168 R; 134/40

[58] Field of Search ..... 210/521, DIG. 9, 923; 134/10, 22.1, 167 R, 168 R, 39, 40, 22.12, 18, 22.11, 22.14, 22.19, 24; 239/227; 15/1.7; 405/185, 191

[56] References Cited

U.S. PATENT DOCUMENTS

| | | | |
|---|---|---|---|
| 1,693,885 | 12/1928 | Butterworth | 134/168 R |
| 2,332,940 | 10/1943 | Senke | 210/206 |
| 2,789,804 | 4/1957 | Toulmin, Jr. | 262/1 |
| 2,923,954 | 2/1960 | Babcock | 15/1.7 |
| 3,013,665 | 12/1961 | Schmidt et al. | 210/241 |
| 3,022,792 | 2/1962 | Perkins | 134/168 |
| 3,108,298 | 10/1963 | Gelinas | 15/1.7 |
| 3,341,880 | 9/1967 | Young | 15/257 |
| 3,436,263 | 4/1969 | Strenkert et al. | 134/22 |
| 3,542,593 | 11/1970 | Pribbernow | 134/24 |
| 3,556,407 | 1/1971 | Niikura et al. | 239/227 |
| 3,628,670 | 12/1971 | McGuire et al. | 210/528 |
| 3,694,263 | 9/1972 | Korn | 134/3 |
| 3,700,849 | 10/1972 | Zuzelo | 299/18 |
| 3,753,777 | 8/1973 | Thomsen et al. | 134/6 |
| 3,837,028 | 9/1974 | Bridge | 15/50 R |
| 3,941,692 | 3/1976 | Gutnick et al. | 210/11 |
| 3,985,572 | 10/1976 | Petermann et al. | 134/34 |
| 4,117,564 | 10/1978 | Russo | 15/1.7 |
| 4,153,553 | 5/1979 | Davis | 210/95 |
| 4,154,680 | 5/1979 | Sommer | 210/169 |
| 4,168,557 | 9/1979 | Rasch | 15/1.7 |
| 4,240,174 | 12/1980 | Thiem et al. | 15/1.7 |
| 4,276,094 | 6/1981 | Gutnick et al. | 134/10 |
| 4,341,232 | 8/1982 | Maton | 134/107 |
| 4,364,776 | 12/1982 | McBride et al. | 134/10 |
| 4,437,988 | 3/1984 | James | 210/521 |
| 4,515,747 | 5/1985 | Creek et al. | 165/11.2 |
| 4,518,437 | 5/1985 | Sommer | 134/22.1 |
| 4,595,419 | 6/1986 | Patenaude | 131/1 |
| 4,636,137 | 1/1987 | Lemelson | 901/1 |
| 4,643,616 | 2/1987 | Castel et al. | 405/191 |
| 4,652,204 | 3/1987 | Arnett | 901/1 |
| 4,720,213 | 1/1988 | Gernhardt et al. | 405/190 |

FOREIGN PATENT DOCUMENTS

| | | | |
|---|---|---|---|
| 951618 | 3/1964 | United Kingdom . | |
| 2027473 | 2/1980 | United Kingdom | 405/185 |

OTHER PUBLICATIONS

*Websters' Third New International Dictionary*, 1965 p. 1964.

*Primary Examiner*—H. M. S. Sneed
*Assistant Examiner*—Sharon T. Cohen
*Attorney, Agent, or Firm*—Pennie & Edmonds

[57] ABSTRACT

A method utilizing a portable hydraulic apparatus for cleaning the hydrocarbon contaminated sludge deposit of an oil storage tank with a fluidizing agent, the tank having a floor, a side wall and a passageway through the side wall positioned adjacent the floor of the tank, comprises a frame having a central portion and first and second end portions. The frame is configured and dimensioned to pass through the passageway. A pair of independently movable endless chain belts are position on opposite sides of the frame for selectively moving the frame within the oil storage tank to selected locations. A hydraulic line coupled to the central portion of the frame discharges the fluidizing agent onto an adjacent first portion of the sludge deposit so as to form a pool of sludge and fluidizing agent. A suction pump is positioned on the central portion of the frame for drawing up the pool of sludge and fluidizing agent. A plurality of nozzles disposed adjacent the first end portion of the frame are in fluid communication with the suction pump so as to provide pressurized agitation and discharging of the pool of sludge and fluidizing agent onto a second portion of the sludge deposit adjacent said first end portion of the frame so as to dislodge and also aid in liquifying the second portion of the sludge deposit. The chain belts and suction pump are driven preferably by a pair of separately operable hydraulic motors supported on the frame.

40 Claims, 7 Drawing Sheets

METHOD FOR CLEANING CHEMICAL SLUDGE DEPOSITS OF OIL STORAGE TANKS

FIELD OF THE INVENTION

The present invention relates to a portable apparatus utilized in a method for cleaning the inside of large oil storage tanks and containers particularly those which are used to store or transport crude oil or other heavy oils.

BACKGROUND OF THE INVENTION

Oil storage tanks which include stationary storage tanks, tank cars, ocean going tankers, barges, pipelines or other structures for storing or transporting crude oil or petroleum products will over a period of time accumulate large amounts of sludge made up of chemical or hyrocarbon deposits which deposits occur particularly in crude oils or heavy oils. Such buildup of sludge over a period of time limits the load carrying or storage capacity of the vessel. Buildup of sludge in oil conveyors also constitutes excess dead weight when the conveyor is returned empty from a delivery point to a shipping point. This increases the cost of operation. In addition, the sludge can interfere with the discharging ports or discharging distribution lines positioned within the storage tank. For this reason, removal of the sludge becomes desirable in order to provide for sludge free exit ports from the storage tank itself. Consequently, the interiors of such storage tanks must be cleaned periodically to remove the accumulation of sludge.

Moreover, with the increasing cost of petroleum products, it has become necessary to utilize whatever hydrocarbon oils are available and to minimize waste. The amount of recoverable oil from sludge is high and therefore it is desirable that the sludge itself be removed from the storage tank and be reprocessed so as to permit the recovery of the usable oil contained therein.

Furthermore, vessels which carry or store crude oil or other petroleum products, are often utilized to carry other products besides oils or carry other grades of oils as well. Thus, it becomes necessary to cleanse the interior of such vessels prior to becoming loaded with other products or higher grades of oil. Vessels of this type must be cleansed to a gas free state from time to time so they may be entered for periodic inspection or for repair in the event of damage. Techniques for cleaning oil carrying vessels or storages tanks has involved the use of steam and water applied in large volumes through spray nozzles against the interior side walls of the vessels under high pressure. Occasionally chemicals are used in the cleaning process but generally such cleaning systems involve the use of large volumes of water as well. These techniques for cleaning have proved to be labor intensive, energy intensive and generally result in the formation of large volumes of oil containing waste water. Moreover, storage vessels cleaned utilizing these techniques are often not completely or fully free of hydrocarbon deposits and are not suitable for upgrading and carrying or storing other products without further hand cleaning of the interior of the vessel. For this reason, it is typically required that persons enter the storage tank facility tank itself and manually remove the remaining deposits on the storage tank floor or walls themselves.

The standard method for cleaning an oil storage tank requires the extensive use of manual labor inside of the tank. In tanks which are free of inside obstruction by any structural members or heating pipes, front end loaders can sometimes be utilized for the cleaning operation. However, this requires cutting of a large hole in the side of the tank to permit entry of the front end loader. More often, specially designed vacuum trucks are employed to remove the sludge from the manway opening. Laborers then using shovels, squeegees, and the like, must work inside the tank manually in order to remove the sludge to the pick up point.

As noted above, the principal method of cleaning settled sludge from oil storage tanks involves the following general approaches. The tank is drained to lowest possible level using on site drain pumps and pipes. Larger pumps and/or vacuum trucks are brought to the site to remove the remaining sludge. Thereafter steam is sparged into the sludge to heat, loosen and reduce the viscosity of the unmovable sludge. Water is next injected below the sludge to enhance flotation of the sludge itself. In instances where the tank is free from obstructions on the floor, an opening in the tank wall is made for a front loader tractor to enter and move the sludge out of the tank. Alternatively, spraying devices which can be employed consist of a centrally erected nozzle which uses a high pressure stream of circulating oil to dislodge the sludge as in the aforementioned methods noted above.

An example of a typical known process for the recovery of tanks sludge hydrocarbons is disclosed in a publication entitled "What does it take to squeeze profits from tank sludge" by the Baker Oil Recovery Corporation. This publication disloses the R.U.S.H. process which is intended to reduce exposure of plant personnel to dangerous elements by eliminating the need to enter the tank. After analyzing the particular oil tank facililty to be cleansed, a predetermined ratio of chemicals, water, solvent, and crude oil is determined which will be employed by the technicians to formulate a metastable oil-in-water emulsion so as to provide for ease and cleansing of the tank. Typically, normal manway covers are removed and replaced with specially-designed metal discs. Next, fluid injection lances are inserted through the metal discs and into the tank. Thereafter the predetermined volumes of chemicals, water and solvent are mixed and pumped through the lances, into the sludge, and then back into the blending tank. This circulation continues on a daily basis until the sludge is satisfactorily emulsified. Next the pumps are shut off and gravity is allowed to separate the oil and water phases. The water layer is then discharged for treatment by means of normal effluent systems while the recovered hydrocarbon is blended back into a fresh crude for reprocessing. However, despite the improvements by this recovery process, typically ten percent of the original volume of sludge remains in the tank bottom as a semi-solid residue. Thus, the Baker Oil Recovery System is not able to fully cleanse a tank but admittedly leaves behind a residue which typical injection methods are not able to cleanse.

Other known methods include the continual circulation of the oil contents of the tank by means of pressure pumps which are positioned within the tank. An example of such pumps is provided in the trade brochure entitled "The Butterworth P-43 Machine For Economical Sludge Control In Crude Oil Storage Tanks", copyright 1981, which involves a twin-nozzle cleaning machine designed for cleaning sludge from the bottom of crude oil storage tanks. Its operation involves directing submerged jets of oil horizontally across the bottom of the tank. In this fashion, the oil is constantly circulated so as to avoid the creation of sludge. Although this methoo constitutes a preventive example of operation in order to avoid the creation of sludge, the energy required to continually operate the pump eventually makes the method of operation undesirable. Moreover, there is no assurance that the bottom sludge formation is totally avoided.

Other typical cleaning devices and methods are disclosed in various patent literature. U.S. Pat. No. 3,556,407 is directed to a cleaning device for cleaning tanks of oil tankers. The device includes a flange which is provided on an upper deck UDF of an oil tanker. A jet nozzle body is mounted at the lower part of the device and includes two attached nozzles which are symmetrically separated by 180° in the same plane. Cleaning water is introduced into the device from above the UDF and finally is emitted from the nozzles.

U.S. Pat. No. 3,628,670 is directed to a cleaning apparatus for oil tanks. The device is intended to prevent any sediment from building up on the bottom of the tank by the continuous and automatic sweeping action of an arm. The cleaning apparatus is positioned at the bottom of the tank and includes a bridge structure or frame having spider like members which are integrally attached to a hub. The ends of the members are fixably attached to the tank wall by welding or other suitable means. The frame serves to provide a hub for rotatably mounting the top end of a rod whose opposite end is rotatably mounted to the bottom of the oil tank. A concave arm is attached to the rod and has a ball roller at its outer end. In this fashion, the arm can be rotated along the bottom of the tank and thereby the settlement buildup is avoided or prevented. This device also renders unnecssary any scraping of the hardened sediment from the tank bottom.

Other typical oil cleaning tank devices are disclosed in U.S. Pat. Nos. 4,153,555; 4,117,564; 4,341,232.

We have invented an improved portable oil tank storage cleaning device which provides a safer and more efficient method of cleaning oil tanks and containers which periodically require, for reason of repair, change in stored oil, or loss of working volume, the removal of accumulated sludge.

DISCLOSURE OF THE INVENTION

The present invention is directed to portable hydraulic apparatus for cleaning residual deposits with a fluidizing agent comprising frame means; means for selectively moving the frame means toward said residual deposits; first means coupled to the frame means for discharging the fluidizing agent onto a first portion of the residual deposits adjacent the frame means so as to form a pool of sludge and fluidizing agent; suction means coupled to the frame means for drawing up at least a portion of the pool of sludge and fluidizing agent; and second means in fluid communication with the suction means for directing the portion of said pool of sludge and fluidizing agent under pressure away from said frame means. The apparatus of the present invention is also adapted for cleaning the hydrocarbon residual deposits of an oil storage vessel.

In one preferred embodiment, the portable hydraulic apparatus of the present invention for cleaning the hydrocarbon contaminated sludge deposit of an oil storage tank with a fluidizing agent, the tank having a floor, a side wall and a passageway through the side wall positioned adjacent the floor of the tank, comprises frame means having a central portion and first and second end portions, the frame means being configured and dimensioned to pass through the passageway; track means movably mounted on the frame means for selectively moving the frame means within the oil storage tank to selected locations; first means coupled to the central portion of the frame means for discharging the fluidizing agent onto a first portion of the sludge deposit adjacent said central portion so as to form a pool of sludge and fluidizing agent; suction means positioned on the central portion of the frame means for drawing up the pool of sludge and fluidizing agent; second means disposed adjacent the first end portion of the frame means in fluid communication with the suction means to provide pressurized agitation and discharge of the pool of sludge and fluidizing agent onto a second portion of the sludge deposit adjacent the first end portion of the frame means so as to dislodge and also aid in liquifying the second portion of the sludge deposit; and means for driving the track means and said suction means.

The suction means is a pump positioned generally centrally on the frame means, wherein the pump has a mouth portion positioned adjacent to the floor of the tank so as to draw up the pool of sludge and fluidizing agent. The pump can be of the positive displacement type and preferably is a progressing cavity pump. Alternatively, the pump can be a centrifugal pump.

The means for driving the track means and the suction means comprises hydraulic motor means and the first discharge means is a hydraulic line having at least one exit port positioned adjacent the pump. The second discharge means includes a plurality of nozzles coupled to the discharge end of the suction means.

The track means includes a pair of independently movable endless chain belts, preferably of the sprocket type, positioned on opposite sides of the frame means. The track means also includes a plurality of sprocket wheels independently rotatably positioned on opposite sides of the frame means and in cooperating engagement with the sprocket chain belts.

According to one preferred embodiment, the sprocket chain belts are covered with non-metallic members such as neoprene so as to prevent any sparking when the sprocket chain belts engage the floor of the storage tank.

The means for driving the track means includes a pair of separately operable hydraulic motors supported on the second end portion of the frame means and coupled correspondingly to the pair of endless chain belts for selective independent movement of the pair of endless chain belts.

The apparatus of the present invention further comprises mixing means in fluid communication intermediate the suction means and the second discharge means for agitating the pool of sludge and fluidizing agent so as to liquify the sludge prior to pressurized discharge onto the second portion of the sludge deposit. The mixing means comprises a closed wall member defining a passageway and having an inlet end and an outlet end and having separator means to divide the passageway into a plurality of channels through which the pool of sludge and fluidizing agent are directed. Preferably, the separator means includes a plurality of corrugated sheet members positioned in adjacent contacting relation to define the plurality of channels.

The apparatus further comprises means for visual detection of its location and orientation within the tank which is in the form of at least one antenna upstanding from each end portion of the frame means. The antenna is of sufficient length so as to extend above the level of the sludge to provide visual indication. Preferably, the antennae are of respectively different colors to facilitate determination of its orientation within the tank.

The present invention is also directed to a portable system for cleaning the sludge deposit of an oil storage tank with a fluidizing agent, the tank having a floor, a side wall and a passageway through the side wall positioned adjacent the floor of the tank. The system comprises a hydraulically driven portable apparatus as described noted above and control means in fluid communication with the hydraulically driven portable apparatus for hydraulically selectively controlling the operation of the driving means and thereby of the track means and the suction means.

The system includes a hydraulic power means in fluid communication with the hydraulically driven portable apparatus for providing a source of hydraulic power for opertion of the driving means. The system further includes a container of fluidizing agent in fluid communication with the hydraulically driven portable apparatus for supplying the fluidizing agent to the first discharging means. A pump means is positioned outside of the oil storage tank and in fluid communication with the portable hydraulic apparatus for drawing the liquidified sludge out of the tank.

The control means comprises a speed control means in fluid communication with the hydraulic power means and the track driving means for regulating tne speed of the track means. The speed control means is hydraulically adapted to provide selective regulation of the track means to operate at at least one of two or more speeds. Preferably, the speed control means is hydraulically configured so as to selectively regulate the track means to operate at either a relatively predetermined slow speed or a relatively predetermined fast speed.

The present invention is also directed to a method for cleaning the chemical sludge deposit of a chemical storage tank comprising discharging a fluidizing agent onto a first portion of the sludge deposit so as to form a pool of sludge and fluidizing agent; drawing up at least a portion of the pool of sludge and fluidizing agent; and spraying the portion of the pool of sludge and fluidizing agent under pressure for directing the portion of the pool to a second portion of the sludge deposit so as to dislodge the second portion of sludge deposit. This method is also applicable to cleaning the chemical sludge deposit of an oil storage tank.

Alternatively, the method of the present invention comprises, prior to spraying, the step of agitating the portion of the pool of sludge and fluidizing agent so as to liquify the sludge. Preferably, the step of agitating the pool is performed by a mixing means comprising a closed wall member defining a passageway and having inlet and outlet ends and having separator means to divide the passageway into a plurality of channels through which the pool of sludge and fluidizing agent are directed. The separator means includes a plurality of corrugated sheet members positioned in adjacent contacting relation to define the plurality of channels.

The above described methods further comprise selectively repeating the aforementioned steps as desired so as to clean the sludge deposit to a predetermined level.

According to a preferred embodiment of operation, the method of the present invention for cleaning the sludge deposit of an oil storage tank having a passageway positioned adjacent the floor of the tank with a portable hydraulic vehicle, comprises passing the vehicle through the passageway into the tank; predeterminately positioning the vehicle within the tank at selected locations; discharging from the vehicle a fluidizing agent onto a first portion of the sludge deposit so as to form a pool of sludge and fluidizing agent; drawing up the pool of sludge and fluidizing agent into the vehicle; and spraying the pool of sludge and fluidizing agent under pressure for agitating the pool of sludge and fluidizing agent so as to liquify the sludge and for directing the liquified sludge to a second portion of the sludge deposit so as to dislodge and aid in liquifying the second portion of the sludge deposit. But for the first step, the remaining steps are selectively repeated as desired to clean the sludge deposit to a predetermined level. The vehicle is a double tracked vehicle adapted so as to be driven in any predetermined direction within the storage tank and is operable by a control means at least a portion of which is positioned outside of the tank. The portion of the control means positioned outside of the tank is coupled to the vehicle by means of an umbilical type cord comprising a plurality of hydraulic cables. The vehicle is controlled in its operation solely by hydraulic means.

The step of drawing up of the sludge and fluidizing agent is by means of a positive displacement pump, preferably a progressing cavity pump. The progressing cavity pump as well as each of the tracks of the vehicle are powered by the said hydraulic power source.

The step of spraying the pool of sludge and fluidizing agent includes passing the pool through a plurality of nozzles which eject the pool under pressure in a predetermined direction.

The method further comprises the step of removing the liquified sludge from the oil storage tank.

The step of discharging a fluidizing agent preferably includes admitting a mixture of water and an emulsifying agent through a hydraulic cable into the vehicle and thereafter through jetting ports onto the first portion of the sludge deposit.

In an alternative embodiment, the method of the present invention includes, before spraying, the step of agitating the pool of sludge and fluidizing agent so as to liquify the sludge.

After passing the vehicle into the tank, the preferred method of the present invention further comprises selectively repeating the remaining steps as desired to clean the sludge deposit to a predetermined level.

Thus, the tank cleaning apparatus of the present invention is a device which can be remotely operated from outside of the tank. The apparatus creates, with the use of surface active chemicals, an emulsion of the oil in water. Alternatively with solvents such as diesel, a solution of the oil can be created which can thereafter be pumped out by the machine or in other well known fashions. The device of the present invention reduces the manual effort otherwise required. It creates a fluid which can be reclaimed and upgraded for fuel or further refining. It is hydraulically powered to reduce the possibility of fire or explosion which otherwise is accompanied in the event of electrically operated devices or the like.

In a preferred embodiment, the device of the present invention is designed to be transported on a trailer with its hydraulic hoses in a form of umbilical cords mounted on reels. The apparatus requires a hydraulic power unit and equipment in order to dispose of the fluidized sludge.

The tank cleaning apparatus of the present invention includes a system consisting of the following components, namely, a crawler, an umbilical assembly, and a trailer. The crawler denotes a hydraulically powered, mobilized progressing cavity pump which discharges through an optional static mixer and thereafter through a set of nozzles. There are two forms of preferred locomotion which are available to accomodate different types of tank floors. Chains can be provided or equipped with non-metallic cleats mounted on sprockets and idler wheels along each side of the crawler so as to provide tractor or tank type treads. This type of locomotion system can be utilized with smooth tank floors free from obstructions. However, when obstructions such as heating coils are present heavily threaded automobile tires can be adapted to elevate the crawler and to widen its wheel base. The pump suction is directed downward so as to draw the sludge through a metal screen strainer positioned beneath the crawler. Water and emulsifying surfactants or a diluting solvent are injected inside the strainer to the pumps inlet so that both water with chemicals and sludge can enter the pump simultaneously. The fluid which is now in a well dispersed and reduced viscosity emulsion state is discharged at a high velocity back onto the settled sludge on the tank floor so as to dislodge the same. The high velocity spray both loosens and fluidizes the packed sludge. Additional oil sludge is also entrained into the emulsion. The crawler can advance through the tank until all of the oil sludge is emulsified and can then be easily pumped out. Power is supplied to the crawler through hydraulic lines or hoses which enable the power to be generated at a safe distance from outside of the tank. Additional hydraulic hoses facilitate the remote control of the crawlers motion and also provide the water-emulsifier solution to the inlet area of tne pump. The entirety of these hydraulic hoses is referred to as the crawler's umbilical.

A trailer is also provided or equiped with hose reels to facilitate the handling of the umbilical and also for transporting the crawler to various tank sites. Ramps are employed inside and outside of the tank adjacent the manhole cover so as to enable the crawler to drive off the trailer through an API (American Petroleum Institute) standard manway and thereafter down onto the tank floor. Such manways typically are 24 inches in diameter. The trailer, which is free of sources of ignition can therefore remain next to the tank during all phases of cleaning.

With respect to the pumping system, any type of centrifugal or positive displacement pump may be substituted for the preferred moyno pump. An agitator blade may also be substituted for the pump itself.

BRIEF DESCRIPTION OF THE DRAWINGS

The present invention is described in detail below with reference to the drawings wherein.

BRIEF DESCRIPTION OF THE PREFERRED EMBODIMENT

In the description which follows, any reference to either orientation or direction is intended primarily for the purpose of illustration and is not intended in any way as a limitation of the scope of the present invention.

The present apparatus and method have been developed in conjunction with the use of chemical formulations which have been designed to emulsify and reduce the viscosity of heavy sludge and settlements such as are found on the bottoms of crude oil and petroleum product storage tanks as well as transportation vessls. Such emulsifying chemicals are described, for example, in U.S. Pat. No. 4,276,094, which is incorporated herein in its entirety, wherefore no further discussion is believed necessary of the appropriate or suitable chemical which may be utilized with the apparatus of the present invention.

In order for the aforementioned chemical formulations to work efficiently, some method of agitation or mechanical energy input is required. The known device such as the "Butterworth" type spray nozzles as well as the aforementioned external recirculation systems do not provide adequate mixing in all cases. The device of the present invention thus provides the necessary energy input and the mixing required in order to fluidize heavy sludge when used in conjunction with either the solvents or emulsifying agents noted above.

Figure 1:
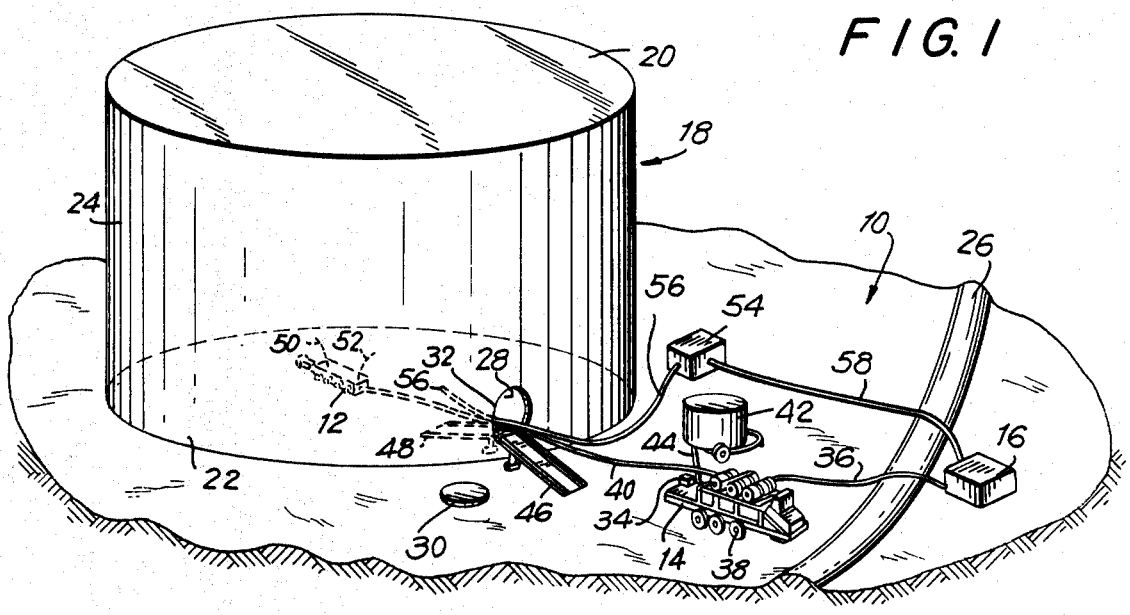
FIG. 1 is a perspective view partially in cross section of the apparatus of the present invention in operation within an oil storage tank.

Referring to the drawings, a preferred embodiment of the system according to the present invention is shown in operation in FIG. 1 as element 10 which includes a crawler 12, a trailer 14 and a hydraulic power unit 16. The crawler 12 is positioned for operation within a storage vessel or tank 18 which has a top wall 20, floor 22 and a cylindrical side wall 24. Such oil storage tanks typically are 40 feet tall and 150 feet in diameter. A dike wall 26 typically four feet high and about fifty feet away from the oil storage tank 18 is positioned around the tank 18 as shown in FIG. 1 in accordance with general fire hazard standards. The hydraulic power unit 16 and a truck (not shown) which can be hitched to trailer 14 are positioned outside of the dike wall 26 to keep all ignition sources safely away from the storage tank 18. The hydraulic power unit 16 provides hydraulic fluid under pressure. The hydraulic power unit 16 includes in one preferred embodiment a diesel engine which drives a hydraulic pump which draws fluid from the reservoir at atmospheric pressure. The presence of the diesel engine constitutes a fire hazard and therefore is positioned on the outside of the dike wall 26. The storage tank 18 has a series of manholes 28 of which only one is shown in FIG. 1 for purposes of ease of illustration. The manhole 28 is covered by a plate 30, shown disassembled in FIG. 1, which can be bolted onto flange 32 that is positioned about the opening of the manhole 28.

The oil storage tank 18 can contain anywhere from one to three or four feet of sludge which is a heavy viscous material that is a water and oil emulsion where the oil is a continuous phase with water emersed therein.

The crawler 12 of the present invention can be transported to the location site upon the trailer 14 which as noted above can be hitched to a truck (not shown). Once the trailer 14 is positioned between the storage tank 18 and the dike wall 26, the truck is removed beyond the dike wall to remove any ignition sources as noted above. The trailer 14 supports a remote hydraulic control system 34 that can be taken from the trailer 14 and positioned at any location as desired. Both the remote control system 32 and hydraulic power unit 16 are coupled by hydraulic lines, e.g., 36 to a series of reels 38 on the trailer 14 which are further coupled to the crawler 12 by an umbilical cord 40 which includes a series of hydraulic lines for operational control of the crawler 12. The reels 38 and umbilical cord 40 provide for ease of handling of the various hydraulic lines employed. A supply tank 42 containing water/emulsifier or other solvent to be used in the process of liquifying the sludge is positioned adjacent the trailer 14 and is hydraulically coupled to the hose reel system 38 by a hydraulic hose system 44. Alternatively, the hydraulic control system 34 as well as the power unit 16 and supply tank 42 can be positioned on a single trailer if suitably sized to accommodate all of the equipment. In such instance, the ignition hazards involved would require that the trailer 14 be positioned away from the storage tank 18 on the outer side of the dike wall 26.

Although in the preferred embodiment, the water-chemical emulsifier is shown as being provided from the same common source 42, the water can come from any external source or tank which may be available on site at the location of the storage tank 18. The water-emusifier preferably provides for a combination of 70% sludge to about 30% water and less than one percent emulsifier as a desired or preferred composition. Instead of applying a water-emulsifier as a fluidizing agent, alternatively, solvents could be employed if desired. In effect, the solvent takes the place of the water and the chemical emulsifier as the fluidizing agent.

After the crawler 12 is removed from the trailer 14, it can be driven into the storage tank 18 up a ramp 46 as shown in FIG. 1 which is positioned adjacent the manhole 28. A second ramp 48 is positioned within the storage tank 18 to accommodate entry of the crawler 12 onto the floor 22. If desired, the outside ramp 46 can be bolted to the flange 32 of the manway 28 so as to secure the ramp 46 in relation to the storage tank 18 while the crawler 12 is traveling upwards over the ramp 46. The crawler 12 is suitably dimensioned and configured so it is capable of passing through the passageway toward manhole 28 as shown in FIG. 1. Thereafter, the crawler 12 is positioned within the tank 18 at selected locations. The crawler 12 in a preferred embodiment includes two antennae 50 and 52 which include chemically activated lights of different colors positioned at the upper portion of the antennae 50, 52. The latter are visible through the manhole 28 so as to permit observation of both the location and the orientation of the crawler 12 while within and particularly if under the sludge on the floor 22 of the tank 18. In this fashion, the crawler 12 can be observed for positioning anywhere within the tank 18 or continuously driven to various locations for continued operation of agitating and mixing of the sludge with the water-emulsifier or solvent which is provided from tne tank 42 in a manner to be described in greater detail below.

According to one preferred embodiment, a pump and storage unit 54 is positioned outside of the tank 18 and is coupled by a line 56 to the fluidized sludge deposits on the floor 22 for drawing the liquified sludge out of the tank 18. The pump and storage unit 54 can be hydraulically driven by hydraulic power unit 16 as indicated by supply line 58. After the liquified sludge is removed from the tank 18 by means of pump 54 it can remain stored in the storage portion of unit 54 or, alternatively, can be further pumped into a container on a truck (not shown) for removal from the work site and for further processing of the liquified sludge.

As illustrated in FIG. 1, a separate pump unit storage tank combination 54 draws the sludge from the tank 18 through pipe or line 56. Alternatively, the latter can be coupled to the crawler 12 so that the fluidized sludge can be drawn through pipe 56 simultaneously while the crawler is at the same time fluidizing other portions of the tank 18.

Figure 2:
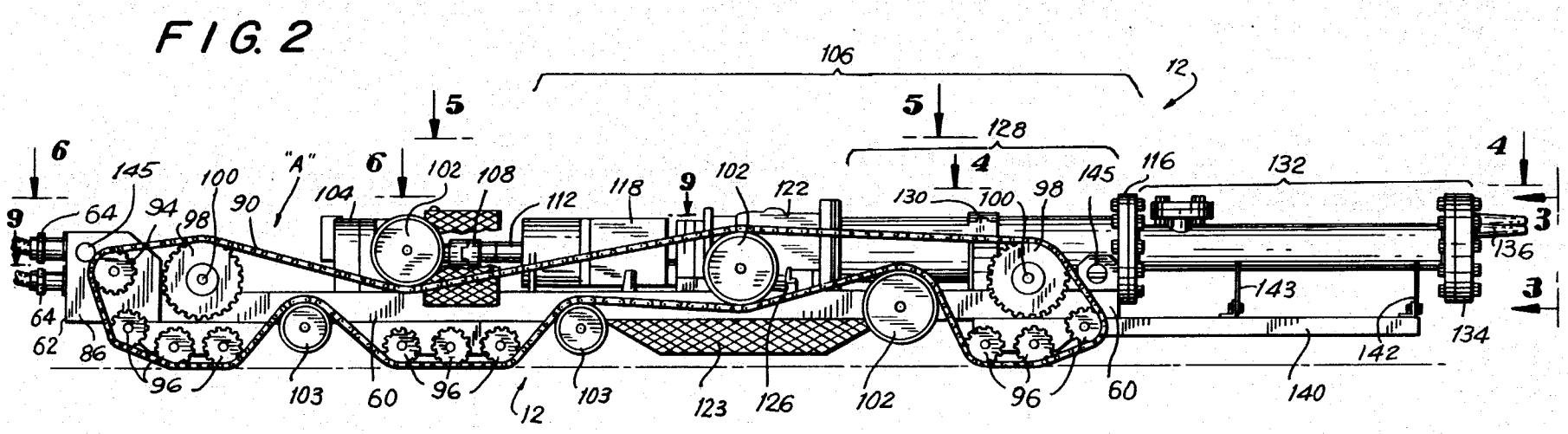
FIG. 2 is a partially exposed side elevational view of the apparatus of the present invention.
Figure 6:
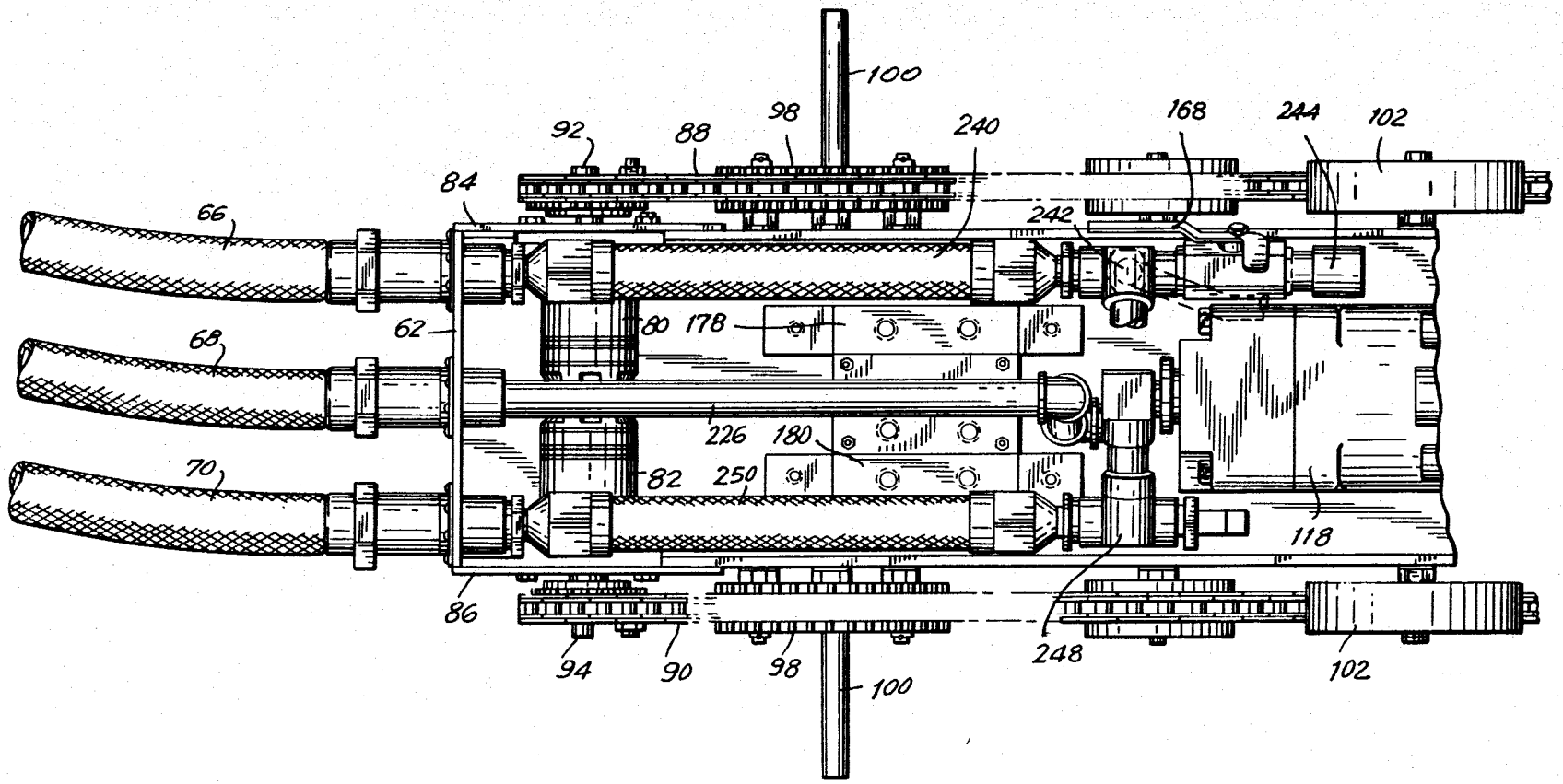
FIG. 6 is a top view of the rear portion of the apparatus of the present invention taken along the line 6—6 of FIG. 2.
Figure 9:
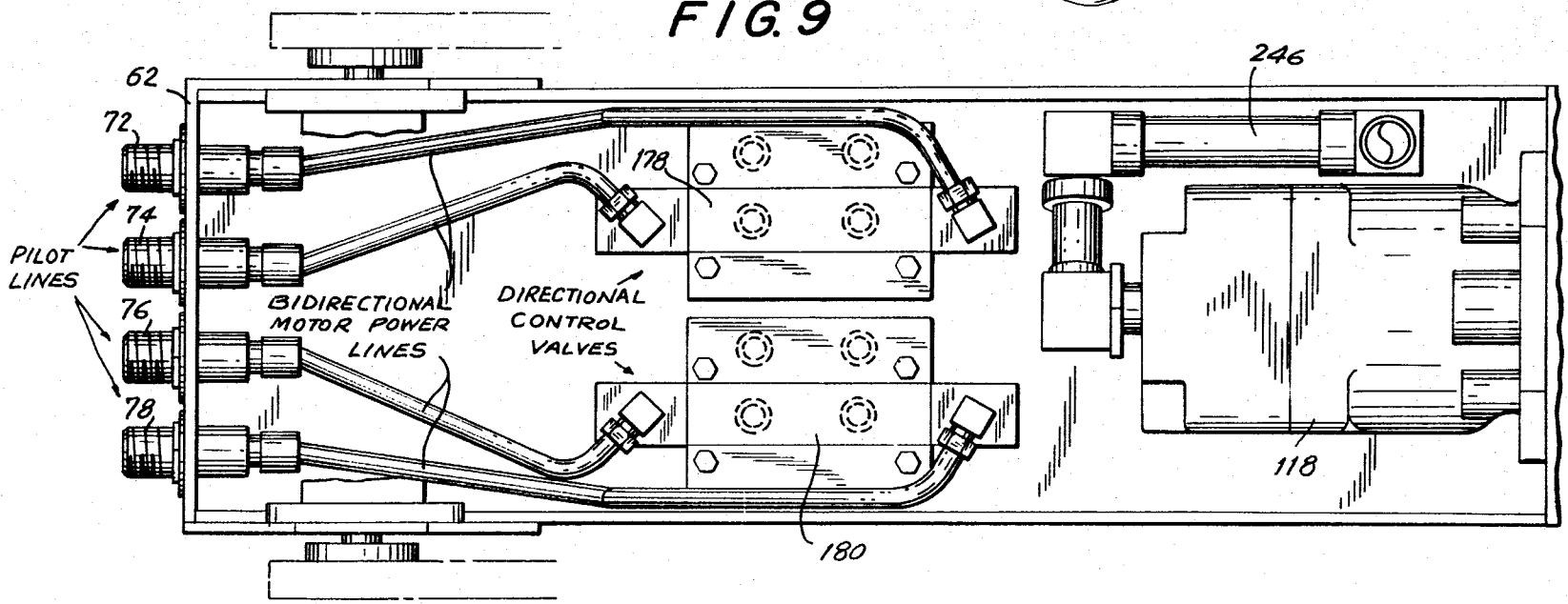
FIG. 9 is a top view of the rear portion of the apparatus of the present invention taken along the line 9—9 of FIG. 2.

Referring to FIG. 2, the crawler 12 is shown with the rear of the device at the left and the front at the right. The crawler 12 includes a longitudinal elongated central frame 60 which provides a mechanical support for the structure positioned thereon as described in greater detail hereinbelow. The rear portion or back plate 62 of the crawler 12 is equipped with seven quick disconnect hydraulic hose fittings or couplings 64 for connecting to respective hydraulic lines. As illustrated in FIGS. 6 and 9 which illustrate two different horizontal levels, the seven hydraulic couplings connect to or include a hydraulic fluid supply line 66, a water-emulsifier supplier line 68, a hydraulic fluid return line 70, pilot hydraulic couplings 72 and 74 for the left crawler treads, and pilot hydraulic control lines 76 and 78 for the rignt crawler treads. Hydraulic motors 80 and 82, as shown in FIG. 6, are supported on mounting plates 84 and 86, respectively, which extend upwardly of the rear portion of frame 60. The two hydraulic motors 80, 82 operatively engage two independently movable crawler treads 88 and 90, respectively, by means of drive sprockets 92 and 94 as shown in part in FIG. 2. The two motors 80 and 82 are bi-directional and can be operated independently of each other in order to facilitate the manueverability of the crawler 12. In this manner, the crawler 12 can be moved in any desired direction by suitable operation of either or both treads in either direction to any desired location within the tank 18.

Figure 4:
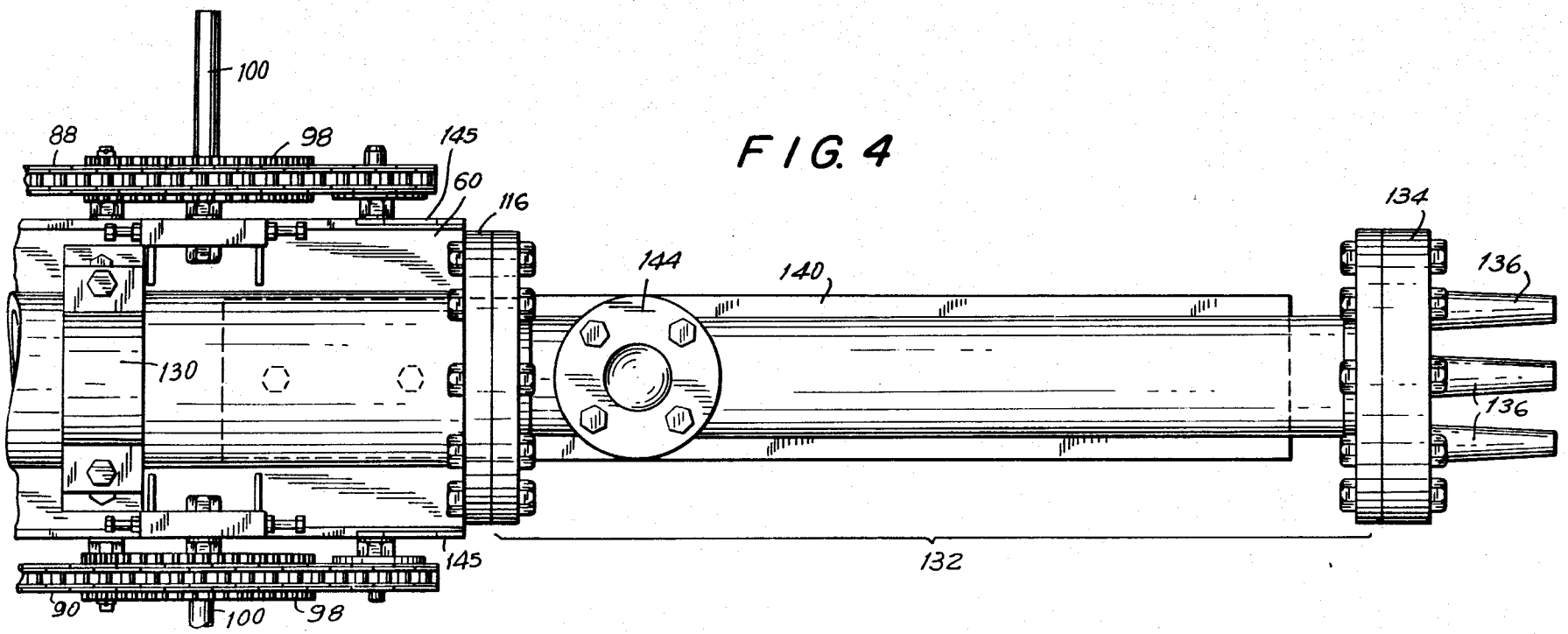
FIG. 4 is a top view of the front portion of the apparatus of the present invention taken along the line 4—4 of FIG. 2.

The treads 88 and 90 are supported by a plurality of idler wheels, which for purposes of ease of illustration will be described with reference to tread 90 only with the understanding that a similar configuration exists in symmetry for tread 88. Positioned at the bottom of frame 60 are three sets of three separate idler sprocketed wheels 96 which are mounted independently of like idler wheels corresponding to tread 88 so that each side of idlers is free wheeling independently of the other side as well as with respect to each other. Two larger diameter sprocket wheels 98 having outwardly extending axles 100 as shown in FIG. 4 are positioned at the forward and rear portions of treads 88 and 90. Three like-sized smooth wheeled idlers 102 having a drameter approximately equal to wheels 98 are positioned and illustrated in FIG. 2. These smooth wheels 102 are coated with neoprene or a like substance so as to avoid the creation of any sparks which would render the present device a fire hazard within the storage tank 18. For the same reason, pieces of nepoprene are mounted to the chains forming the treads 88 and 90 as described in greater detail below. In addition, the rearmost smooth wheel 102 is adjustable in a vertical direction. The rearmost wheel 102 is position in a groove (not shown) and can be moved vertically up or down by tightening of a set screw so as to regulate its depth within the groove. In this manner, the tension of treads 88 and 90 can be adjusted to any desired degree. Two smooth wheels 103 smaller than 102 are positioned as illustrated in FIG. 2.

Figure 10:
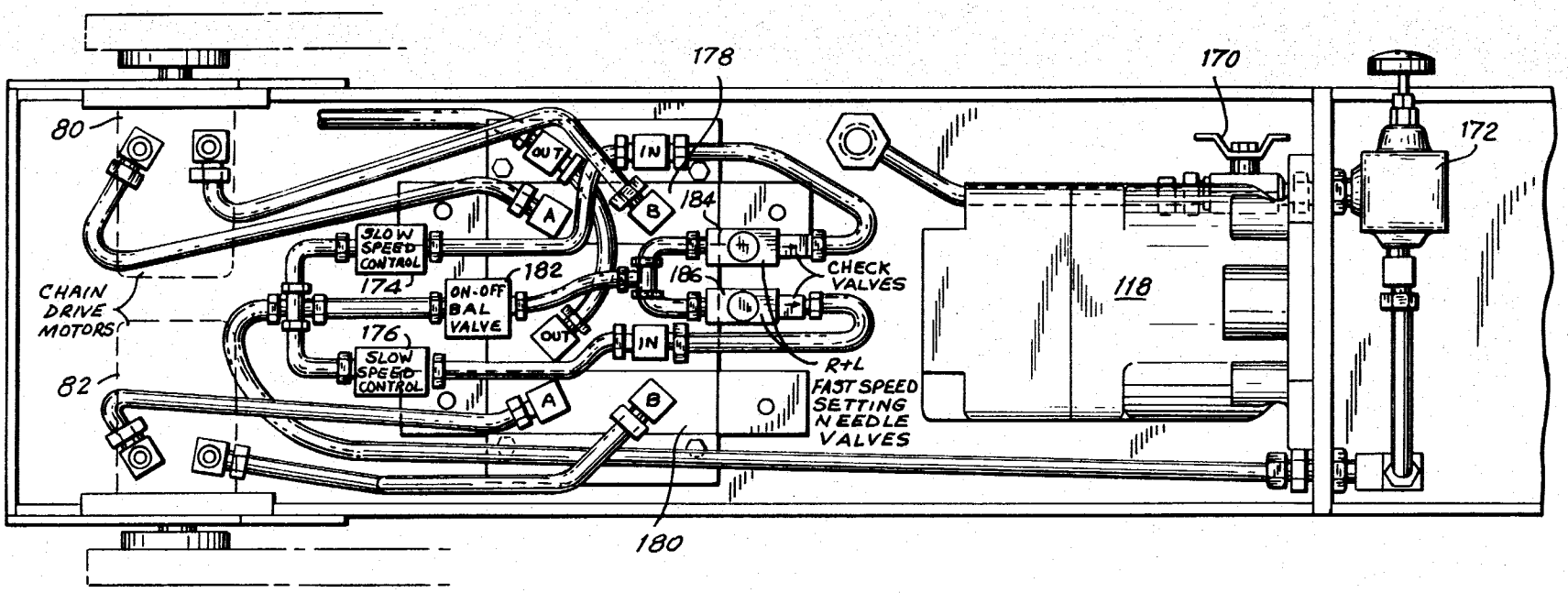
FIG. 10 is a second top view of the rear portion of the apparatus of the present invention taken along the line 9—9 of FIG. 2 wherein certain structure shown in FIG. 9 is omitted.

The nesting of hydraulic circuitry is positioned in the rear end portion of frame 60 as illustrated generally by "A" in FIG. 2 and more detailedly illustrated in FIGS. 9 and 10. Forward of the nesting of hydraulic lines is the hydraulic drive motor 104 which drives the progressing cavity pump illustrated in general as element 106 by means of a coupling 108 which joins the motor shaft 110 to the pump shaft 112 shown in FIG. 5. The coupling 108 is a standard mechanical coupling of a type known to those skilled in the art for joining of two shafts. A preferred progressing cavity pump is of the type as marketed by Robbins-Myers, Springfield, Ohio, under the brand name Moyno. An expanded metal guard 114 is positioned above and about the coupling 108 which operates at a high RPM so as to provide for safe and unobstructed operation of the coupling 108 during rotation. The progressive cavity pump 106 as shown in FIG. 2 includes a drive shaft 112 at its rearmost end portion and a flange 116 at its foremost end portion. The drive end 118 of the progressing cavity pump 106 includes generally shaft bearings, suitable coupling assemblies and a pump packing assembly which are of a type known to those skilled in the art. Although the pump has been described as of a displacement type, preferably as a moyno pump, the pump can also be of the centrifugal or other well known types.

Figure 5:
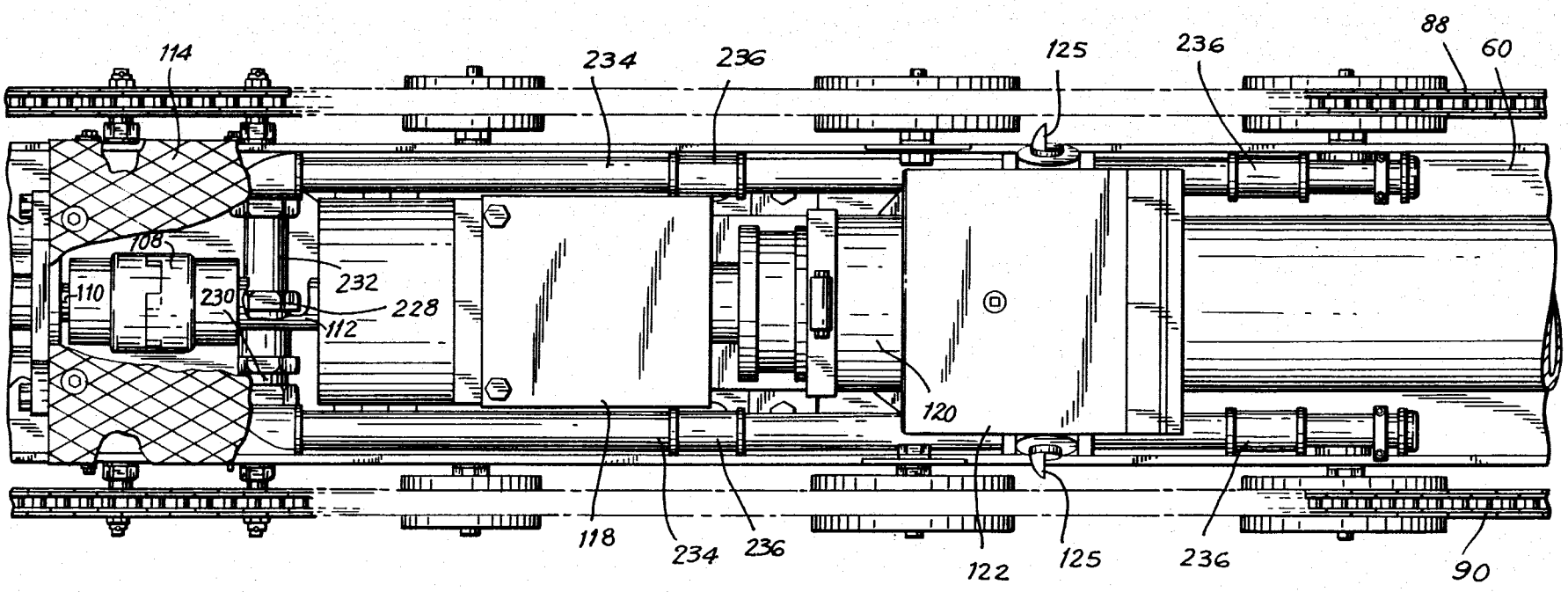
FIG. 5 is a partially exposed top view of the middle portion of the apparatus of the present invention taken along the line 5—5 of FIG. 2.
Figure 7:
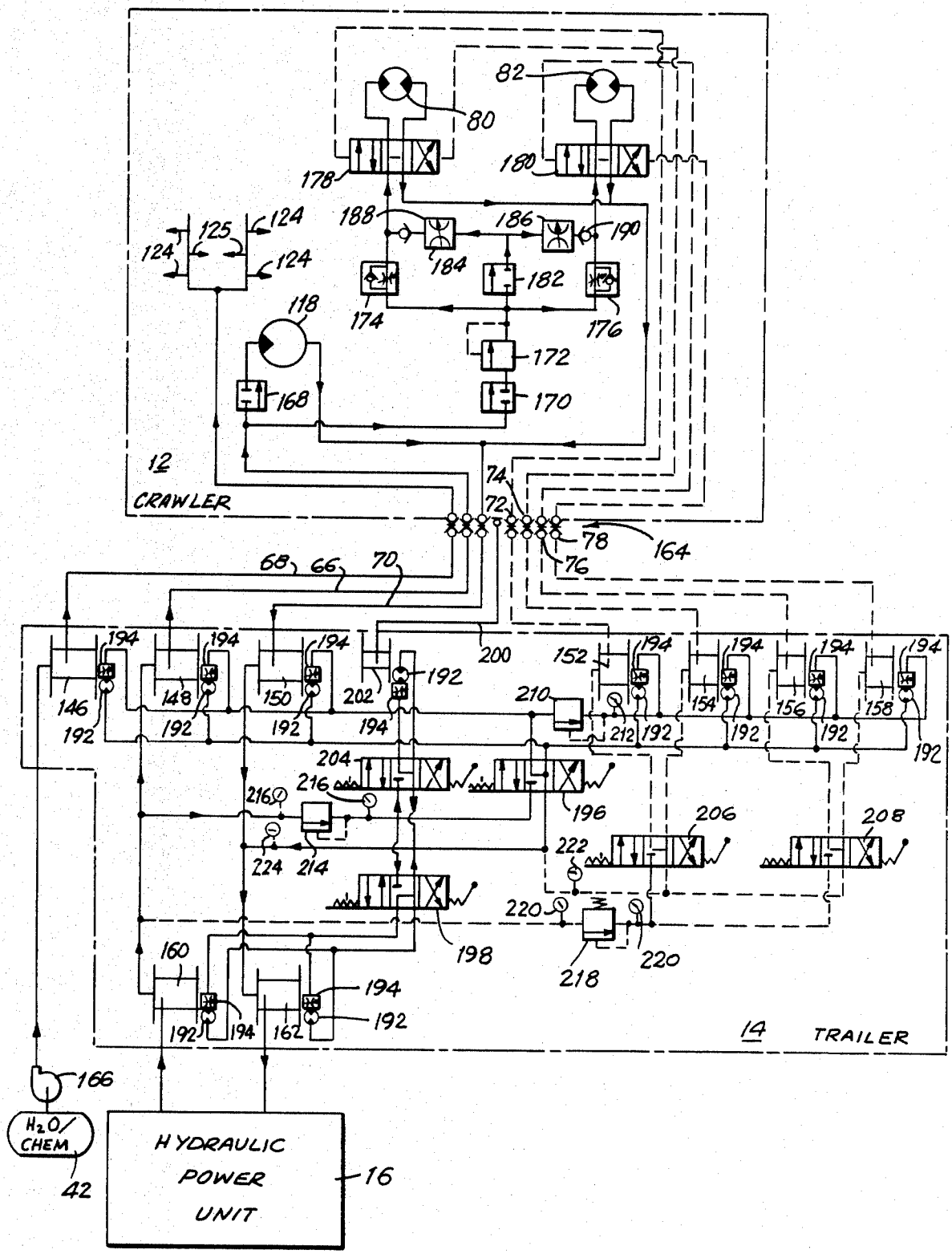
FIG. 7 is a schematic view of a hydraulic system for operating the apparatus of the present invention.

Forward of the drive end 118 is a stuffing box 120 and a suction housing 122 which includes a suction flange (not shown) at its bottom portion. The stuffing box 120 provides a fluid seal around the shaft entering the pump cavity or suction housing 122. The suction flange which surrounds an opening into the suction housing 122 is positioned in correspondence with a hole or aperture (not shown) through frame 60. A guard screen 123 is positioned about the aperture in frame 60 so as to prevent passage of particles that are larger than a predetermined size from entering the pump suction housing 122. Four spray nozzles 124 shown schematically in FIG. 7 are mounted within the screen 123 so as to deliver the fluidizing agent to an adjacent portion of the sludge on the bottom of the storage tank 18 and also to assist in declogging the suction screen 123. Two additional spray nozzles 125 positioned as shown in FIGS. 2 and 5 serve as chain cleaning ports to eject the fluidizing agent onto treads 88 and 90 to provide for cleaning during operation.

The rotor-stator section 128 of the progressive cavity pump 106 is coupled to the suction housing 122. The rotor-stator section 128 is secured to the frame by a wrap-around ring 130 which is bolted to the frame 60 as shown in FIG. 4. The stator is preferably formed of a synthetic rubber and the rotor is formed of carbon steel with chrome plating according to preferred embodiment of the present invention.

At the pump discharge flange 116 can be optionally mounted either a static mixing section 132 or a flange 134 if the static mixing section 132 is not employed. If the static mixing section 132 is used, then the flange 134 is mounted thereto as shown in FIG. 2. Since the static mixing section 132 is optional equipment, the crawler's length can be shortened when it is not employed. The static mixing section 132 includes a series of finally divided, stationery flow channels formed from corrougated sheet members in contacting relationship which mix the sludge and fluidizing agent as it is drawn through the crawler 12. The static mixing section 132 is the type manufactured by the Koch Engineering company of Akron, Ohio. Agitating of the pool of sludge and fluidizing agent within the static mixing section 132 is a function of the pressure loss therethrough. The static mixing section 132 preferably is formed of a set of a plurality of sheet members positioned in adjacent contacting relation to define a plurality of flow channels through which the fluidized or liquified sludge passes.

Figure 3:
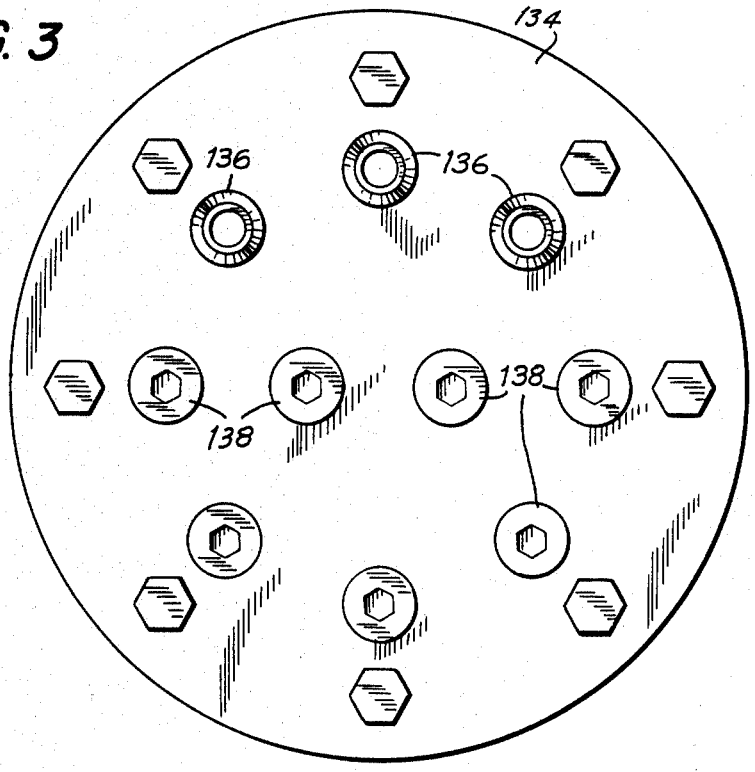
FIG. 3 is a front end view of the discharging nozzles of the apparatus of the present invention taken along the line 3—3 of FIG. 2.

The flange plate 134 includes a pattern of drilled and taped holes for mounting of nozzles 136 as shown more clearly in FIGS. 3 and 4. Additional nozzle holes are capped with plugs 138 and can be removed for insertion of yet other suitable nozzles as desired. The nozzles 136 which are commercially available are of a type known to those skilled in the art and provide for a varied selection of spray patterns. According to preferred embodiment, the nozzles 136 are selected which will impart a high velocity jet spray directed toward the floor 22 of tank 18 so as to dislodge and liquify a portion of the sludge adjacent the forward end of the crawler 12.

As shown in FIG. 2, the static mixing section 132 is supported on an extension frame 140 which is secured to the forward end of frame 60 by means of support plates 142. A rupture disk 144 is positioned atop of the static mixing section 132 to permit venting in the case of excessive pressure build up. As illustrated in FIG. 2, the crawler 12 is provided with lifting rings 145 at the forward and rear ends. The crawler 12 can be lifted by a crane and cable from the trailer 14 or can be positioned in this manner to any particular location outside of the tank 18.

Referring to FIG. 7, the hydraulic circuitry of the present invention is schematically illustrated. In FIG. 7, hydraulic power lines are represented by solid lines while control lines are schematically indicated by dashed lines. The flow direction through the hydraulic lines illustrated schematically is represented by directional arrows as indicated in FIG. 7. To facilitate operation and repair, the hydraulic connections on the hoses, control console and the crawler are preferably stamped with corresponding identifying letters and/or numbers. In addition, to avoid improper connection to the hydraulic power unit, the quick disconnect hose fittings to the hydraulic power unit 16 are reversed for ease of correct coupling.

The basic hydraulic principle in operation in the hydraulic system of FIG. 7 is that a fluid under pressure will flow toward a low pressure area. The hydraulic power unit 16 supplies a flow of fluid under high pressure which returns to its reservoir that typically is at atmospheric pressure. In the course of the fluid's circuit through this path, work is performed as the fluid drives various motors that are in its path.

As illustrated in FIG. 7, there are seven separate reels 146, 148, 150, 152, 154, 156 and 158 for paying out or taking up of various hydraulic flow lines, whose directions of flow are indicated by the arrows as shown. Preferably the seven reels are supported on the trailer 14 as shown collectively by element 38. Separate reels 160 and 162 pay out or take up the two hydraulic lines coupled to the hydraulic power unit 16.

By way of illustration of a power fluid flow path, the hydraulic power unit 16 provides hydraulic fluid through input and return hydraulic lines which are coupled as shown in FIG. 7 to reels 160 and 162, respectively, that are supported on the trailer 14. Reels 160 and 162 are fluidly coupled to reels 148 and 150, respectively, and thereafter through suitable hydraulic lines through quick disconnect hose fittings identified collectively as 164 to the crawler 12 and finally through suitable hydraulic lines to the pump drive motor 118 and left and right chain drive motors 80 and 82, respectively. In this fashion, hydraulic fluid under pressure flows from the hydraulic power unit 16 to permit operation of the pump drive motor 118 and chain drive motors 80 and 82. The spent hydraulic fluid returns through line 70 to reel 150, reel 162 and back to the hydraulic power unit 16 through a suitable hydraulic line as illustrated in FIG. 7.

A separate water and/or chemical source supply 42 provides the same through pump 166, a hydraulic line as shown to reel 146 on the trailer 14. Thereafter, fluid line 68 passes the water and/or chemical through a quick disconnect hose fitting 164 to the crawler 12 and finally through the spray nozzles 124 which are positioned adjacent the screen 123.

The operation of the hydraulic circuitry of FIG. 7 will now be described in reference to the control components regulating the operation of that circuitry.

The operation of the pump drive motor 118 is regulated by an on-off valve 168 which is connected into the feed line of the pump drive motor 118 downstream of the quick connect hose fittings 164. The manual valve 168 can be turned on after the crawler 12 is positioned inside the tank 18 to prevent operation of the pump 118 while outside the tank 18. Similarly an on-off valve 170 is connected into the feed line of the chain drive motors 80 and 82. A pressure reducing valve 172, preferably set for a maximum of 1200 pounds per square inch (PSI), is coupled downstream of the on-off valve 170 and is connected parallel to two separate single direction slow speed flow control valves 174 and 176 which couple through 3-position 4-way pilot operated hydraulic directional control valves 178 and 180 and thereafter to the hydraulic inputs of chain drive motors 80 and 82, respectively. The pressure reducing valve 172 protects the hydraulic circuitry from excessive pressure.

A fast speed control network includes on-off valve 182, and downstream coupled variable flow control valves 184 and 186. On-off valve 182 is coupled upstream to pressure reducing valve 172 while variable flow control valves 184 and 186 are coupled through check valves 188 and 190, respectively, into the feed lines of chain drive motors 80 and 82 just upstream of directional control valves 178 and 180, respectively, as depicted in FIG. 7 and downstream of slow speed control valves 174 and 176.

The hydraulic output of chain drive motors 80 and 82 combine downstream of the directional control valves 178 and 180 and thereafter couple with the hydraulic output line of pump drive motor 118 before passing through quick disconnect coupling 164 and line 70, as previously described, back to hydraulic power unit 16.

When manual on-off valve 182 is in the closed position, no fluid passes through fast speed variable flow control valves 184 and 186 but rather through slow speed flow control valves 174 and 176. When on-off valve 182 is in the open position, fast-speed variable flow control valves 184 and 186 are operational.

In this manner, the crawler 12 can be operated at a fast speed while outside the storage tank 18 to effect rapid movement and at slow speed when inside the storage tank 18.

Each of the reels 146–162 is operationally driven by respective bi-directional hydraulic motors 192 and accompanying variable flow control valve 194 shown in FIG. 7 aside reel 146. Each of the hydraulic motor 192—valve 194 corresponding to reels 146, 148, 150, 152, 154, 156 and 158 is controlled by 3-position, 4-way manually operated hydraulic control valve 196. Similarly reels 160 and 162 are controlled by 3-position, 4-way manually operated hydraulic control valve 198.

A cable 200 is connected to crawler 12 and is payed out or wound up on reel 202 whose corresponding hydraulic motor 192—valve 194 is controlled by 3-position, 4-way manually operated hydraulic control valve 204. In this fashion the crawler 12 can be drawn toward the trailer 14 in the event that the crawler 12 cannot be operationally moved by means of treads 88 and 90.

The pair of control lines for regulating the operation of directional control valve 178 are coupled through reels 152 and 154 through 3 position, 4 way manually operated hydraulic control valve 206. Similarly, directional operation of control valve 180 is provided by a pair of control lines which couple to reels 156 and 158 and thereafter to 3 position, 4 way manually operated hydraulic control valve 208.

Each of the hydraulic control valves 196, 198, 204, 206 and 208 has hydraulic feed and return lines which are coupled to the hydraulic power unit 16 as shown in FIG. 7.

A pressure reducing valve 210, preferably set at 1100 PSI, together with gauge 212 are coupled downstream of hydraulic control valve 196. Similarly, pressure reducing valve 214, preferably set at 1200 PSI, with corresponding gauges 216 are coupled upstream of hydraulic control valves 196 and 204. Yet a third pressure reducing valve 218, preferably set at 500 PSI, and corresponding gauges 220 are positioned upstream of hydraulic control valves 206 and 208. An additional gauge 222 provides a reading of the pressure of the return control line while gauge 224 provides a similar function for the power return lines from hydraulic control valves 196 and 204.

Referring to FIGS. 6, 9 and 10, the various hydraulic lines and hydraulic control circuitry as described above and shown in FIG. 7 are illustrated according to a preferred embodiment of the hydraulic circuitry nested in the space noted as "A" in FIG. 2.

It is understood that all hydraulic connections are provided in accordance with methods and couplings well known to those skilled in the art. Similarly, all hydraulic lines are formed of suitable metallic or plastic material which are also well known to those skilled in the art.

With respect to the crawler control portion of the hydraulic circuitry illustrated in FIG. 7 by dashed lines as being positioned on the trailer 14, this circuitry could alternatively be positioned as well on the crawler 12 or on yet an additional platform (not shown) which can be positioned outside of the storage tank 18.

Referring to FIGS. 5 and 6, the flow path of the water-emulsifier from source 42 is passed through fluid line 68, and through a PVC pipe 226. From there the pipe 226 is coupled through a series of elbows to a pipe (not shown) which passes underneath pump drive motor 118 and couples through T fitting 228 and pipe members 230 and 232 to extension pipes 234 which extend in the direction of and are positioned on the crawler frame 60. The cleaning ports 125 are coupled to the extension pipes 234 as shown in FIG. 5. Also, the spray nozzles 124 extend downwardly from extension pipes 234 at four T fittings 236. The spray nozzles 124 extend through suitably sized holes in frame 60 to permit the water-emulsier to be sprayed onto the sludge adjacent thereto. Caps 238 are positioned on the ends of pipes 236 so that any fluid therethrough will pass out of nozzles 124 and cleaning ports 125.

Referring to FIG. 6, the hydraulic power feed line 66 passes fluid through pipe 240, multiple T fitting 242 and couples to valves 168 and 170, the latter being shown in FIG. 10. Thereafter, the powerline as shown in FIG. 10 feeds into the nesting of hydraulic circuitry as illustrated by the notation "A" in FIG. 2. The T fitting 242 couples through pipe and coupling member 244 as shown in FIG. 6 downwardly through further pipe and coupling members 246 as illustrated in FIG. 9 into the pump drive motor 118. The spent hydraulic fluid is then passed out of the pump drive motor 118 through pipe-coupling member 248 and out through the hydraulic return pipe 250 and thereafter through the hydraulic return line 70.

Figure 8:
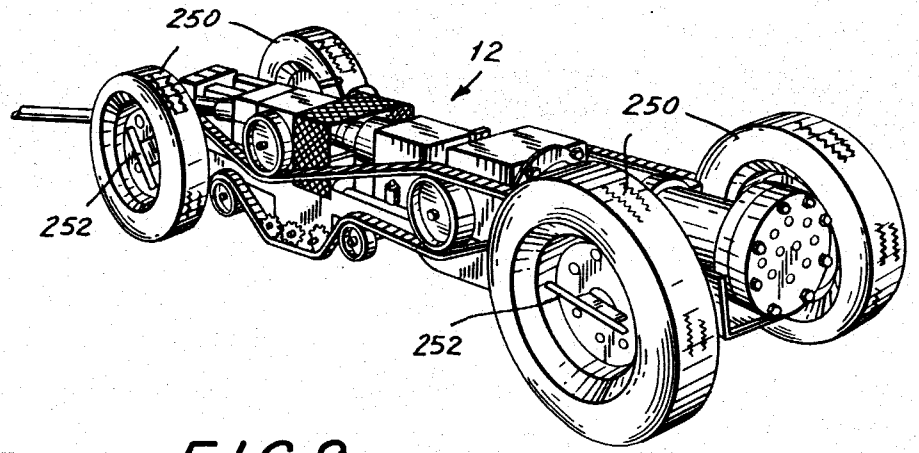
FIG. 8 is a perspective view of an alternative embodiment of the apparatus of the present invention including wheels for purposes of elevated movement of the subject apparatus.

According to an alternative embodiment illustrated in FIG. 8, wheels 250 can be mounted on the axles 100 and retained thereon by means of quick coupling fastener members 252. Because the wheels will not permit the crawler 12 to pass through the manway 28, the crawler would be positioned within the tank and the wheels attached thereto so as to provide for additional clearance of the crawler from the floor of the tank 18. The wheels can be positioned onto the crawler 12 while it is situated on the inside ramp 48 so as to provide clearance above the floor 22 of tank 18. In this fashion the crawler 12 can be converted into a tracked vehicle having wheels 250.

Figure 13:
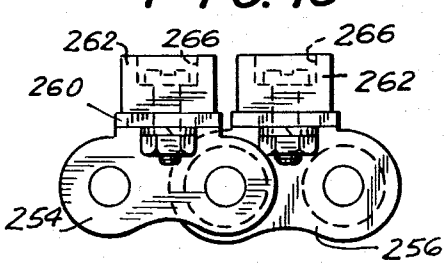
FIG. 13 is a side elevational view of the sprocket type chain belt of FIG. 11.
Figure 12:
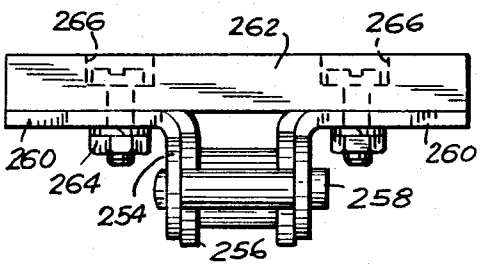
FIG. 12 is a end view taken along the line 12—12 of FIG. 11.
Figure 11:
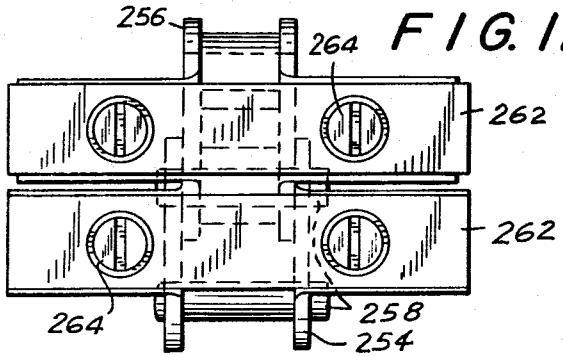
FIG. 11 is a top view of the sprocket type chain belts employed in the driving means of the present invention illustrating non-metallic covering members for prevention of any sparking.

Referring to FIGS. 11–13, the chain belts forming the treads 88 and 90 are illustrated in greater detail. The chain belts are formed of cooperating chain link members 254 and 256 wherein the latter are of a smaller width than the former. As shown particularly in FIG. 13, the chain link members 254 and 256 are coupled by link pin 258. Additional chain link pairs 254 and 256 are coupled by link pins 258 so as to form a continuous or endless loop of the treads 88 and 90. Each of the chain link members 254 and 256 have on their upper surfaces extended shoulders 260 to which are attached non-metallic pads 262, preferably formed of neoprene so as to prevent any sparking as the treads 88 and 90 travel upon the floor 22 of storage tank 18. The neoprene pads 252 can be secured to the sholders 260 according to any method well-known to those skilled in the art. According to one preferred embodiment, the pads 262 are secured by means of bolt-nut combinations 264 which are recessed in radial grooves 262 in the pads 262 so as to avoid any metal to metal contact as the threads 88 and 90 travel on the floor 22.

In operation, the crawler 12 is positioned on a trailer 14 and is positioned adjacent the tank 18 to be cleaned. Thereafter, the ramps 46 and 48 can be positioned inside and outside the tank 18 as shown in FIG. 1. The crawler 12 can then be driven into the tank 18 onto the floor 22. By means of selective operations of the various hydraulic control valves illustrated and described above with reference to FIG. 7, the crawler 12 can be positioned at any desired location and the fluidizing of the sludge can be performed by passing the water-emulsifier or alternatively a solvent which serve as a fluidizing agent by means of nozzles 124 onto the sludge adjacent to the crawler 12. The suction pump 106 draws up the pool of sludge and fluidizing agent adjacent to this suction housing 122. By virtue of the static mixing section 132 the sludge and fluidizing agent are intermixed so as to liquify the sludge which can then be passed out of the nozzles 136 onto a portion of the sludge adjacent thereto. As the crawler 12 is moved forwardly, the pool of sludge and fluidizing agent over which tne crawler 12 passes is drawn into the suction housing 122. As noted above, independent operation of either of the treads 88 or 90 by means of the appropriate hydraulic control valves shown in FIG. 7, the crawler 12 can be positioned where desired within the tank 18.

The operation of the crawler 12 both in terms of its locomotion and the suction pump is provided by means of hydraulic power, preferably from a single source, e.g., the hydraulic power unit 16. After a fluidizing agent is discharged from crawler 12 onto a first portion of the sludge deposit adjacent thereto, a pool of sludge and fluidizing agent is formed. This pool of sludge and fluidizing agent is next drawn up into the crawler 12 and is agitated therein so as to liquify the sludge within the static mixing section 132. Thereafter, the pool of sludge and fluidizing agent is sprayed under pressure for further agitating the pool of sludge and fluidizing agent so as to liquify the sludge. If desired, the liquified sludge can be removed directly from the tank 18 or alternatively can be directed to yet another portion of the sludge deposit by means of the nozzles 136 so as to dislodge and aid in liquifying a second portion of the sludge deposit. If the static mixing section 132 is not employed, the further agitation needed to liquify the sludge and fluidizing agent is provided by means of the high pressure ejection nozzles 136. These operations are continued to the extent desired until effective cleaning of the tank 18 is obtained.

In this fashion, the sludge can be liquified and removed therefrom to provide for an efficient and effective removal of the sludge from the storage tank 18. Alternatively if the static mixing section 132 is not employed, the sludge and fluidizing agent are intermixed and agitated by virtue of the high pressure ejection derived from the nozzles 136. As noted above, this agitation also occurs within the static mixing section 132 if the same is employed. By means of spraying the sludge and fluidizing agent under pressure out of nozzles 136 this action provides for loosening of the sludge adjacent thereto so as dislodge and aid in liquifying that portion of the sludge deposit. The steps of ejecting water-emulsifier or a solvent and moving the crawler 12 about the tank 18 is performed selectively in whatever stages are desired until the desired amount of removal of sludge is effected.

We claim:

1. A method for cleaning the sludge deposit of an oil storage tank having a passageway positioned adjacent the floor of the tank with a portable hydraulic vehicle, comprising:

a. passing the vehicle through the passageway into the tank, the vehicle being operable and controllable solely by hydraulic means so as to avoid all ignition hazards within the tank;
b. predeterminately positioning the vehicle within the tank at selected locations;
c. discharging from the vehicle a fluidizing agent onto a first portion of the sludge deposit so as to form a pool of sludge and fluidizing agent;
d. drawing up said pool of sludge and fluidizing agent into the vehicle; and
e. spraying said pool of sludge of fluidizing agent under pressure for agitating said pool of sludge and fluidizing agent so as to liquify the sludge and for directing the liquified sludge to a second portion of the sludge deposit so as to dislodge and aid in liquifying said second portion fo the sludge deposit.

2. The method of claim 1 wherein said step of drawing up of the sludge and fluidizing agent is by means of a positive displacement pump.

3. The method of claim 2 wherein said positive displacement pump is a progressing cavity pump.

4. The method of claim 3 wherein said progressing cavity pump as well as each of said tracks of the vehicle are powered by the same hydraulic power source.

5. The method of claim 1 wherein said step of spraying said pool of sludge and fluidizing agent includes passing said pool through a plurality of nozzles which eject said pool under pressure in a predetermined direction.

6. The method according to claim 1 wherein said vehicle is operable by a control means at least a portion of which is positioned outside of the tank.

7. The method of claim 6 wherein said portion of said control means positioned outside of the tank is coupled to said vehicle by means of an umbilical type cord comprising a plurality of hydraulic cables.

8. The method of claim 7 wherein said vehicle is controlled in its operation solely by hydraulic means.

9. The method of claim 1 further comprising selectively repeating steps (b) through (e) as desired to clean the sludge deposit to a predetermined level.

10. The method of claim 9 wherein said vehicle is a double tracked vehicle adapted so as to be driven in any predetermined direction within the storage tank.

11. The method of claim 1 wherein said step of discharging a fluidizing agent includes admitting a mixture of water and an emulsifying agent through a hydraulic cable into said vehicle and thereafter through jetting ports onto the first portion of the sludge deposit.

12. The method of claim 1 further comprising the step of removing the liquified sludge from the oil storage tank.

13. A method for cleaning the sludge deposit of an oil storage tank having a passageway positioned adjacent the floor of the tank with a portable hydraulic vehicle, comprising:

a. passing the vehicle through the passageway into the tank, the vehicle being operable and controllable solely by hydraulic means so as to avoid all ignition hazards within the tank;
b. predeterminately positioning the vehicle within the tank at selected locations;
c. discharging from the vehicle a fluidizing agent onto a first portion of the sludge deposit so as to form a pool of sludge and fluidizing agent;
d. drawing up said pool of sludge and fluidizing agent into the vehicle;
e. agitating said pool of sludge and fluidizing agent so as to liquify the sludge; and
f. spraying said pool of sludge and fluidizing agent under pressure for further agitating said pool of sludge and fluidizing agent and for directing the liquified sludge to a second portion of the sludge deposit so as to dislodge and aid in liquifying said second portion of the sludge deposit.

14. The method according to claim 13 wherein said vehicle is operable by a control means at least a portion of which is positioned outside of the tank.

15. The method of claim 14 wherein said portion of said control means positioned outside of the tank is coupled to said vehicle by means of an umbilical type cord comprising a plurality of hydraulic cables.

16. The method of claim 15 wherein said vehicle is controlled in its operation solely by hydraulic means.

17. The method of claim 13 wherein said step of drawing up of the sludge and fluidizing agent is by means of a positive displacement pump.

18. The method of claim 17 wherein said positive displacement pump is a progressing cavity pump.

19. The method of claim 18 wherein said progressing cavity pump as well as each of said tracks of the vehicle are powered by the same hydraulic power source.

20. The method of claim 13 wherein said step of agitating said pool is performed by a mixing means comprising a closed wall member defining a passageway and having inlet and outlet ends and having separator means to divide said passageway into a plurality of channels through which said pool of sludge and fluidizing agent are directed.

21. The method of claim 20 wherein said separator means includes a plurality of corrugated sheet members positioned in adjacent contacting relation to define said plurality of channels.

22. The method of claim 13 further comprising selectively repeating steps (b) through (e) as desired to clean the sludge deposit to a predetermined level.

23. The method of claim 22 wherein said vehicle is a double tracked vehicle adapted so as to be driven in any predetermined direction within the storage tank.

24. The method of claim 13 wherein said step of discharging a fluidizing agent includes admitting a mixture of water and an emulsifying agent through a hydraulic cable into said vehicle and thereafter through jetting ports onto the first portion of the sludge deposit.

25. The method of claim 13 wherein said step of spraying said pool of sludge and fluidizing agent includes passing said pool through a plurality of nozzles which eject said pool under pressure in a predetermined direction.

26. The method of claim 13 further comprising including the step of removing the liquified sludge from the oil storage tank.

27. A method for cleaning the chemical sludge deposit of an oil storage tank comprising:

a. disposing a portable hdyraulic vehicle within the oil storage tank at selected locations, said vehicle being operable, movable and controllable solely by hydraulic means so as to avoid ignition hazards within the tank;

b. discharging from the vehicle a fluidizing agent onto a first portion of the sludge deposit so as to form a pool of sludge and fluidizing agent;

c. drawing up at least a portion of said pool of sludge and fluidizing agent into the vehicle; and d. spraying said portion of said pool of sludge and fluidizing agent under pressure for directing said portion of said pool to a second portion of the sludge deposit so as to dislodge said second portion of sludge deposit.

28. The method of claim 27 further comprising selectively repeating steps (a) through (c) as desired to clean the sludge deposit to a predetermined level.

29. A method for cleaning the chemical sludge deposit of an oil storage tank comprising:

a. disposing a portable hydraulic vehicle within the oil storage tank at selected locations, said vehicle being operable, movable and controllable solely by hydraulic means so as to avoid ignition hazards within the tank;

b. discharging from the vehicle a fluidizing agent onto a first portion of the sludge deposit so as to form a pool of sludge and fluidizing agent;

c. drawing up at least a portion of said pool of sludge and fluidizing agent into the vehicle;

d. agitaing said portion of said pool of sludge and fluidizing agent; and e. spraying said portion of said pool of sludge and fluidizing agent under pressure for directing said portion of said pool to a second portion of the sludge deposit so as to dislodge said second portion of sludge deposit.

30. The method of claim 29 further comprising selectively repeating steps (a) through (d) as desired to clean the sludge deposit to a predetermined level.

31. A method for cleaning the sludge deposit of an oil storage tank comprising:

a. disposing a portable hydraulic vehicle within the oil storage tank at selected locations, said vehicle being operable, movable and controllable solely by hydraulic means so as to avoid all ignition hazards within the tank;

b. discharging from the vehicle a fluidizing agent onto a first portion of the sludge deposit so as to form a pool of sludge and fluidizing agent;

c. drawing up said pool of sludge and fluidizing agent into the vehicle;

d. spraying said pool of sludge and fluidizing agent under pressure for directing the liquified sludge to a second portion of the sludge deposit so as to dislodge and aid in liquifying said second portion of sludge deposit.

32. The method of claim 31 further comprising selectively repeating steps (a) through (c) as desired to clean the sludge deposit to a predetermined level.

33. A method for cleaning the sludge deposit of an oil storage tank comprising:

a. disposing a portable hydraulic vehicle within the oil storage tank at selected locations, said vehicle being operable, movable and controllable solely by hydraulic means so as to avoid all ignition hazards within the tank;

b. discharging from the vehicle a fluidizing agent onto a first portion of the sludge deposit so as to form a pool of sludge and fluidizing agent;

c. drawing up said pool of sludge and fluidizing agent into the vehicle;

d. agitating said portion of said pool of sludge and fluidizing agent so as to liquify the sludge; and e. spraying said pool of sludge and fluidizing agent under pressure for directing the liquified sludge to a second portion of the sludge deposit so as to dislodge and aid in liquifying said second portion of sludge deposit.

34. The method of claim 33 further comprising selectively repeating steps (a) through (d) as desired to clean the sludge deposit to a predetermined level.

35. A method for cleaning the sludge deposit of an oil storage tank comprising:

a. positioning a portable hydraulic vehicle within the oil storage tank at selected locations, said vehicle being operable, movable and controllable solely by hydraulic means so as to avoid all ignition hazards within the tank;

b. discharging from the vehicle a fluidizing agent onto a first portion of the sludge deposit so as to form a pool of sludge and fluidizing agent;

c. drawing up said pool of sludge and fluidizing agent into the vehicle; and d. spraying said pool of sludge and fluidizing agent under pressure for agitating said pool of sludge and fluidizing agent so as to liquify the sludge and for directing the liquified sludge to a second portion of the sludge deposit so as to dislodge and aid in liquifying said second portion of sludge deposit.

36. The method of claim 35 further comprising selectively repeating steps (a) through (c) as desired to clean the sludge deposit to a predetermined level.

37. A method for cleaing the sludge deposit of an oil storage tank comprising:

a. positioning a portable hydraulic vehicle within the oil storage tannk at selected locations, said vehicle being operable, movable and controllable solely by hydraulic means so as to avoid all ignition hazards within the tank;

b. discharging from the vehicle a fluidizing agent onto a first portion of the sludge deposit so as to form a pool of sludge and fluidizing agent;

c. drawing up said pool of sludge and fluidizing agent into the vehicle;

d. agitating said portion of said pool of sludge and fluidizing agent so as to liquify the sludge; and e. spraying said pool of slude and fluidizing agent under pressure for further agitating said pool of sludge and fluidizing agent so as to liquify the sludge and for directing the liquified sludge to a second portion of the sludge deposit so as to dislodge and aid in liquifying said second portion of sludge deposit.

38. The method of claim 37 further comprising selectively repeating steps (a) through (d) as desired to clean the sludge deposit to a predetermined level.

39. The method of claim 37 wherein said step of agitating said pool is performed by a mixing means comprising a closed wall member defining a passageway and having inlet and outlet ends and having separator means to divide said passageway into a plurality of channels through which said pool of sludge and fluidizing agent are directed.

40. The method of claim 39 wherien said separator means includes a plurality of corrugated sheet members positioned in adjcent contacting relation to define said plurality of channels.

* * * * *